US005261753A

United States Patent [19]

Endoh et al.

[11] Patent Number: 5,261,753

[45] Date of Patent: Nov. 16, 1993

[54] PRINT HEAD FOR DOT MATRIX PRINTERS

[75] Inventors: Toshihiro Endoh; Takashi Moriya, both of Tokyo, Japan

[73] Assignee: Citizen Watch Co., Ltd., Tokyo, Japan

[21] Appl. No.: 59,183

[22] Filed: May 7, 1993

Related U.S. Application Data

[63] Continuation of Ser. No. 685,841, Apr. 15, 1991, abandoned.

[30] Foreign Application Priority Data

Apr. 18, 1990 [JP] Japan ..... 2-42030[U]

[51] Int. Cl.[5] ..... B41J 3/12

[52] U.S. Cl. ..... 400/124; 101/93.05

[58] Field of Search ..... 400/124; 101/93.04, 101/93.05, 93.29

[56] References Cited

U.S. PATENT DOCUMENTS 4,394,093 7/1983 Asano et al. ..... 101/93.05

4,772,141 9/1988 Sanders et al. ..... 101/93.05

4,828,409 5/1989 Sparshott et al. ..... 101/93.05

*Primary Examiner*—Edgar S. Burr

*Assistant Examiner*—Ren Yan

*Attorney, Agent, or Firm*—Koda and Androlia

[57] ABSTRACT

A print head for use in dot matrix printers for producing characters and symbols formed from dots. The print head is composed of a plurality of stylus actuator assemblies arranged one after the other in two interlocking rows and with all the styli level with each other on a head frame. Each of the stylus actuator assemblies comprises an electromagnetic actuator fixed to the head frame and energized by an impact driving current, a yoke base fixed to the stylus actuator assembly, and an armature pivotally supported on the yoke base and at one end thereof having a stylus for printing and at the other end thereof having a plunger attracted by the electromagnetic actuator, whereby the stylus is impacted onto a recording paper. All armatures of the stylus actuator assemblies have bent portions provided on the same side thereof with respect to the direction in which the print head traverses.

2 Claims, 5 Drawing Sheets

PRINT HEAD FOR DOT MATRIX PRINTERS

This is a continuation of application Ser. No. 685,841, filed Apr. 15, 1991, now abandoned.

BACKGROUND OF THE INVENTION

1. Field of the Invention

This invention relates to a print head for use in dot matrix printers, and more particularly to a print head for use in dot matrix printers for moving and impacting print styli onto recording paper against a platen by an armature electromagnetically driven by an electromagnet.

2. Description of the Related Arts

Generally, a dot matrix printer which is capable of forming characters, numerals, and other symbols on recording paper by the use of a plurality of dots has been widely known and has been used recently in various fields of industry in printers of data processing system.

U.S. Pat. No. 4,986,179 owned by the inventors of this application discloses a print head for use in such printers, and FIG. 3 of the accompanying drawings is a cross sectional plan view showing the configuration of a stylus actuator assembly comprised in the print head. In FIG. 3, a stylus actuator assembly 20 is placed in position on a head frame 22, that is, a position where the stylus actuator assembly 20 can give impact to recording paper against a platen "P", and screwed with a fixing screw 30 provided in an electromagnetic actuator 28 which is composed of a core 24 with a coil 26 wound therearound.

An armature 32 is attached to the central portion of a torsion leaf spring 34 having torsional property, and the torsion leaf spring 34 is fixed to the stylus actuator assembly 20, thereby supporting the armature 32.

On the top side of a support rack portion 38 fixedly positioned by both an electromagnetic actuator 28 and a yoke base 36 mounted to the actuator 28, a torsion leaf spring rest 40 is provided. The torsion leaf spring 34 is placed in position on this torsion leaf spring rest 40 and secured thereon with a fixing bolt 44 through a spring presser 42.

The armature 32 is mounted to a torsion spring 34 by means of a rivet, brazing, or spot welding.

At one end, the armature 32 has a stylus holder 48 for holding a stylus 46, confronting a platen roller. At the other end, opposite to the position of the stylus 46, the armature 32 has a plunger 50 attracted by electromagnetic force exerted from a coil 26 of the electromagnetic actuator 28.

At the support rack portion 38 is fixed with a screw 54, confronting the stylus holder 48, a damper 52 which absorbs impact caused when the stylus 46 is forcibly restored to the original position by the torsional force of a torsion spring 34.

As shown in FIG. 5A and 5B, the armature 32 has a bent portion **32*b*, which is bent substantially orthogonally to a base portion 32*a*, on its right side relative to an imaginary line drawn from the plunger 50 to the stylus 46. This bent portion 32*b* provides the armature 32** with rigidity.

FIG. 4 shows an arrangement in which the stylus actuator assemblies 20 are mounted on the head frame 22. A plurality of stylus actuator assemblies 20 are arranged one after the other in two rows in such a manner that a stylus actuator assembly in one row confronts a stylus actuator assembly in the other row adjacently and with all of the styli 46 in a line.

Since the armatures of the stylus actuator assemblies 20 in both rows have the same shape, it can be said that the bent portions **32*b* of the armatures 32** in the lower row are situated on a backward side thereof whereas the those on the armatures in the upper row are situated on an advancing side thereof.

Referring to FIG. 3, the operation of the print head will be described hereinbelow.

When printing on recording paper, a predetermined impact driving current is supplied to the electromagnetic actuator 28, the core 24 is excited, and then the plunger 50 of the armature 32 is attracted by electromagnetic force in the direction of the arrow 100.

At this time, the armature 32 moves pivotally around the torsion spring 34 center, the stylus 46 supported at one end of the armature 32 is driven and impacted in the direction of the arrow 200 opposite to the direction in which the plunger 50 on the other end of the armature 32 is attracted. Thus, dot printing is effected by the tip end portion of the stylus 46.

However, according to the conventional print head for dot matrix printers, since the armatures having the same structure are arranged in both upper and lower rows, the direction of impact displacements of the armatures is different between the upper row and the lower row because the torsional force of the armature 32 produced by rigidity thereof may differ depending on the location of the bent portion relative to the traversing direction of the print head. The rigidity of the armature may be differed depending on the position of the bent portion **32*b*** relative to the head traveling direction.

The result of this is that dots are formed unevenly spaced from each other in any traverse direction thereto, and this uneven spacing of dots due to variations of the torsional force among styli is discernible and detrimental to print quality. Therefore, there has been a demand for preventing such unevenness of dots and obtaining an arrangement which forms evenly spaced dots.

SUMMARY OF THE INVENTION

Accordingly, this invention aims to overcome the above mentioned drawbacks in the prior art, and it is an object of the present invention to provide a print head for use in dot matrix printers which are capable of preventing uneven spacing among dots in any direction traverse thereto by a print head comprising a plurality of stylus actuator assemblies all of which cause impact displacements in the same direction relative to the traversing direction of the head unit and produces an arrangement of evenly spaced dots without discernible dot gaps.

To this aim, according to one aspect of this invention, there is provided a print head for use in dot matrix printers for effecting printing with a traverse movement of the print head in a back and forth direction, the print head comprising a plurality of stylus actuator assemblies mounted and arranged one after the other in two rows with a face-to-face relation on a head frame. Each of the units has an electromagnetic actuator mounted on a head frame and energized by an impact driving current, and an armature pivotally supported on a yoke base by means of a torsion leaf spring and at one end thereof holding a stylus for printing and at the other end thereof having a plunger attracted by the electromagnetic actuator, whereby the printing stylus is impacted onto a recording paper.

The print head having the above structure in characterized in that all of the bent portions of the stylus actuator assemblies in both rows are positioned on the same side thereof relative to the traversing direction of the print head.

Therefore, according to the print head having the above-described structure, since all of the stylus actuator assemblies in both rows are arranged on the head frame with all of the bent portions disposed on the same side with respect to the traversing direction of the print head and with all of the styli in a line, it becomes possible to align impact displacements of the armatures in the same direction and prevent uneven spacing of dots.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION OF PREFERRED EMBODIMENT

Figure 1A:
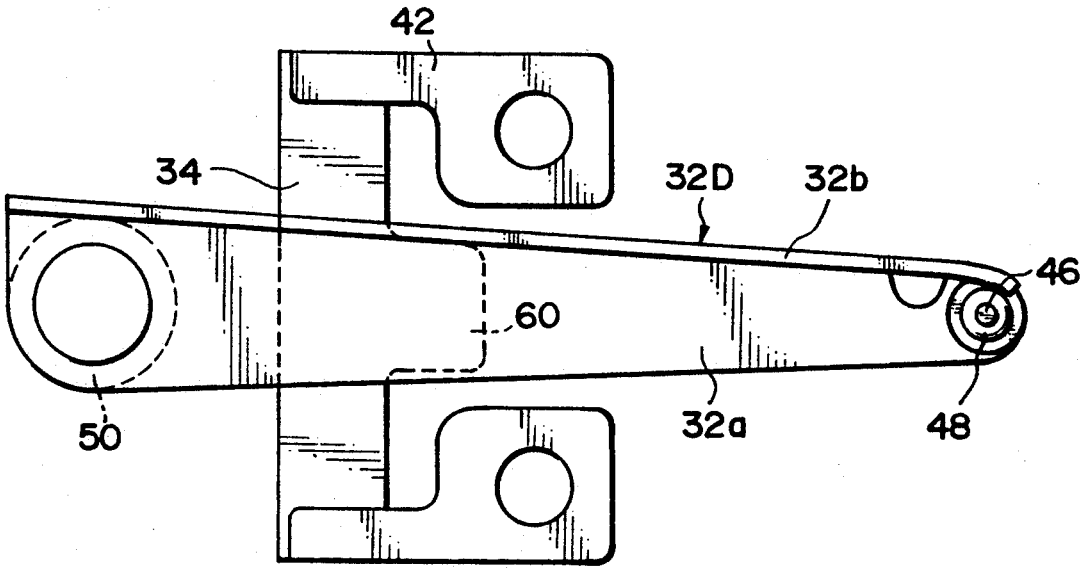
FIGS. 1A and 1B are a top plan view and a side elevation view showing an armature according to one embodiment of the present invention.
Figure 1B:
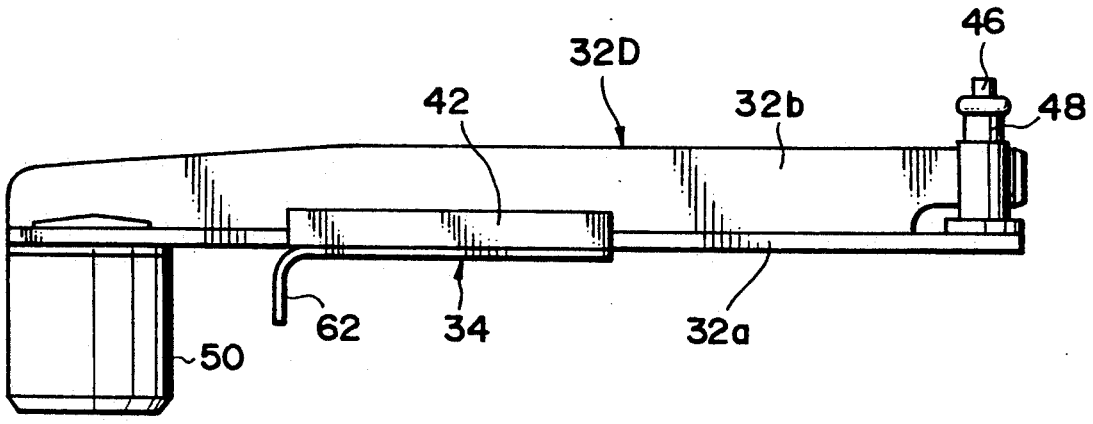
Figure 2:
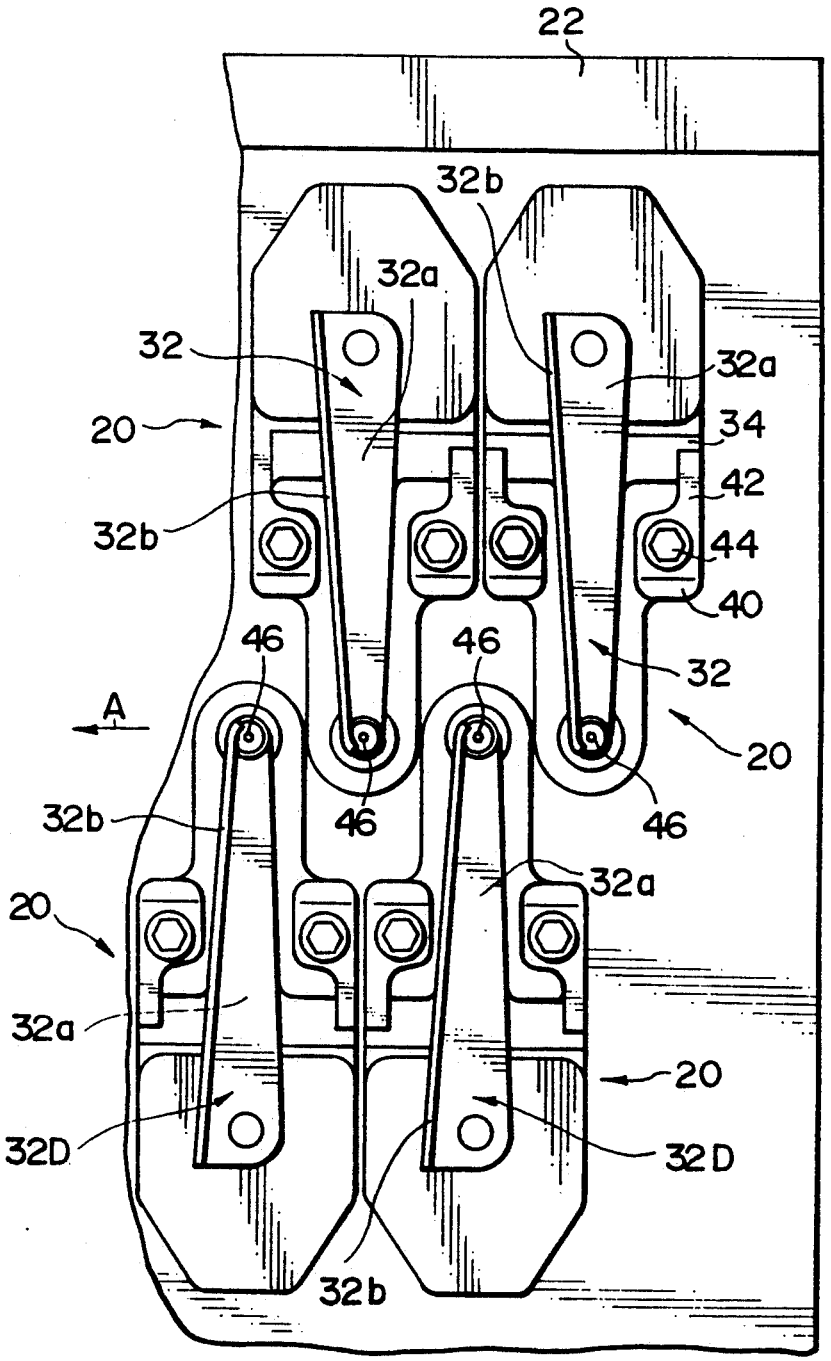
FIG. 2 is an elevation view showing the arrangement, on a head frame, of the stylus actuator assemblies embodying the present invention.
Figure 3:
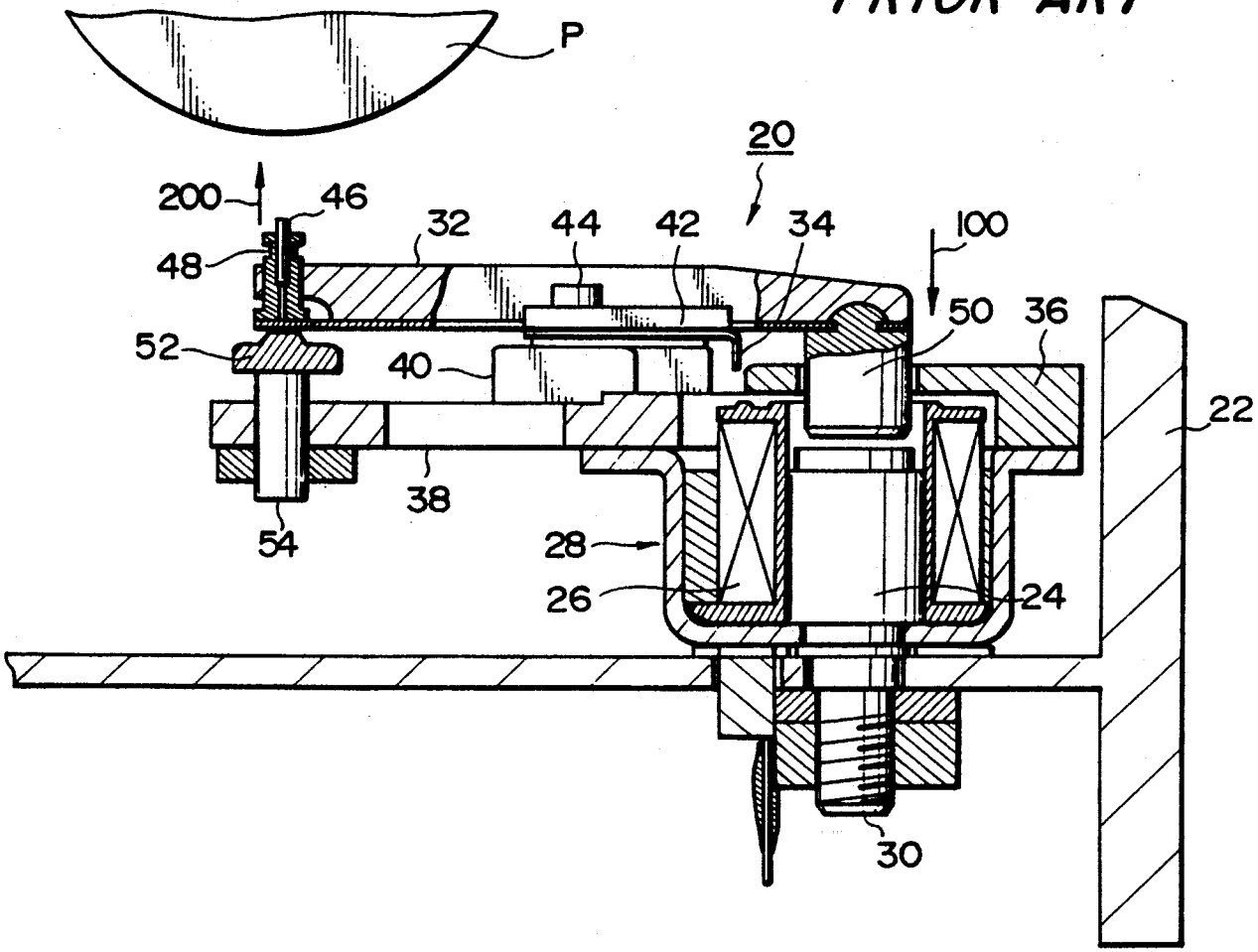
FIG. 3 PRIOR ART
FIG. 3 is a sectional view showing a configuration of a conventional stylus actuator assembly.
Figure 4:
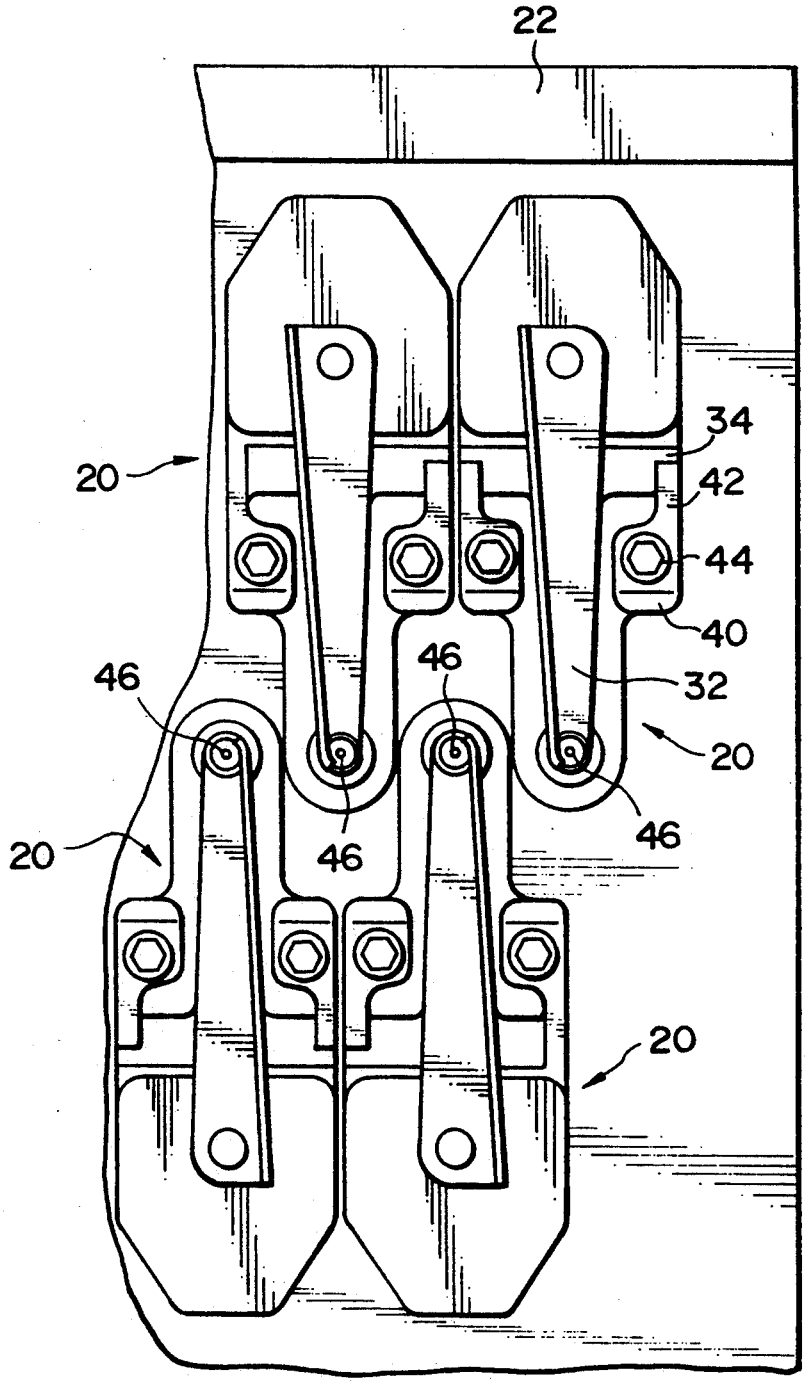
FIG. 4 PRIOR ART
FIG. 4 is an elevation view showing the arrangement of the conventional stylus actuator assemblies.
Figure 5A:
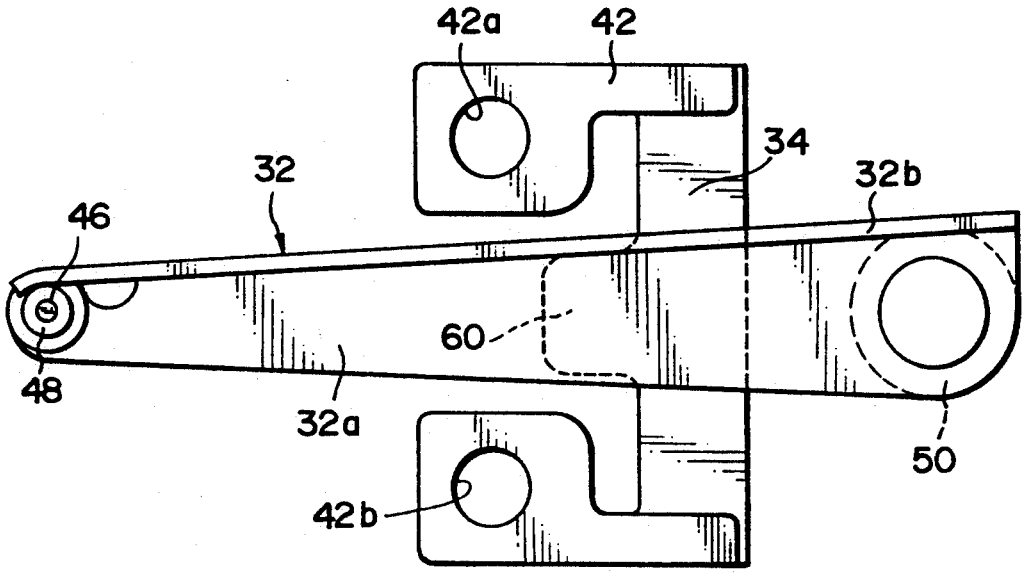
FIG. 5A PRIOR ART
FIGS. 5A and 5B are a top plan view and a side elevation view showing a conventional armature.
Figure 5B:
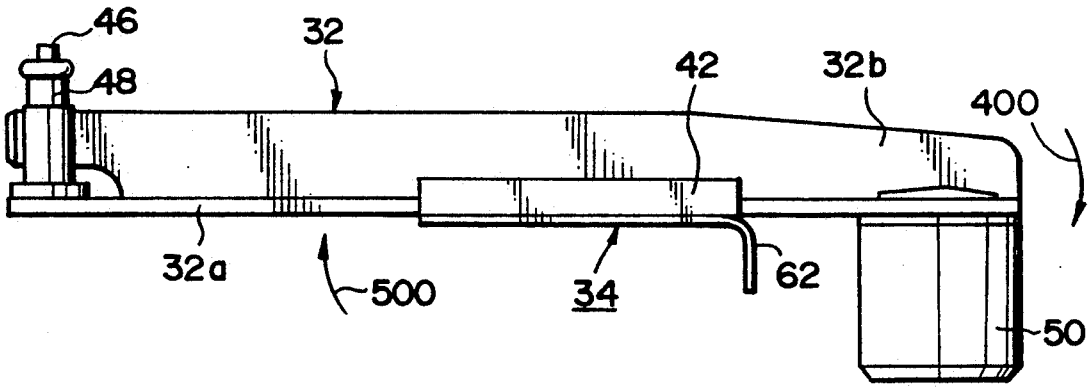
FIG. 5B PRIOR ART

Referring to FIGS. 1A, 1B and 2, an embodiment of the present invention will now be described.

FIGS. 1A and 1B are a top plan view and a side elevation view showing an armature 32D of a stylus actuator assembly 20. FIG. 2 is an elevation view showing the arrangement of the stylus actuator assemblies 20 mounted on a head frame 22.

Referring to FIG. 2, the armature 32D in the lower row has a bent portion **32*b*, which is bent substantially orthogonally to the base portion 32*a*, provided on the left side thereof with respect to an imaginary line drawn from the plunger 50 to the stylus 46, and the bent portion 32*b* provides the armature 32D** with rigidity.

With reference to FIG. 2, the armature 32 in the upper row, like the conventional stylus actuator assembly, has a bent portion **32*b*, which is bent substantially orthogonally to the base portion 32*a*, provided on the right side thereof relative to an imaginary line drawn from the plunger 50 to the stylus 46. The bent portion 32*b* provides the armature 32** with rigidity.

Thus, when the stylus actuator assemblies 20 having the armature 32 in the upper row and the stylus actuator assemblies 20 having the armature 32D in the lower row are mounted on the head frame 22, it may be said that the bent portions **32*b* in the upper row and the bent portions 32*b*** in the lower row are positioned on the same side of the assemblies relative to the traversing direction of the head unit.

Accordingly, when effecting printing with the back and forth traverse of the print head against the platen, a predetermined impact driving current is supplied to the electromagnetic actuator 28, and the core 24 is excited. The electromagnetic force of the core 24 attracts the plunger 50 in the direction of the arrow 100. The stylus 46 supported on the one end of the armature 32 is driven to give impact in a direction opposite to the direction of the arrow 200 in which the plunger 50 attached at the other end of the armature 32 is attracted.

At this time, the rigidity of the armature 32 in the upper row differs between the right and left sides thereof relative to the imaginary center line drawn from the plunger to the stylus, thereby causing impact displacements in a direction of arrow A whereas the armatures 32D in the lower row also have a difference between the right and left sides thereof relative to the imaginary center line from the plunger to the stylus, there by causing impact displacements in a direction of the arrow A.

Thus, since both the armatures 32 in the upper row at and the armatures 32D in the lower row cause impact displacements in the same direction of the arrow A, any discernible uneven gap can be prevented.

As described above, according to the print head for use in dot matrix printers of the present invention, since all armatures have bent portions on the same side relative to the direction in which the print head traverses, impact displacements are caused in the same direction when printing, thereby preventing unevenness of dot gaps.

While this invention has been described with reference to an illustrative embodiment, this description is not intended to be construed in a limiting sense. Various modifications of the illustrative embodiment, as well as other embodiments of the invention, will be apparent to those who are versed in the art upon reference to this description. It is, therefore, contemplated that the appended claims will cover any such modifications or embodiments as fall within the true scope of the invention.

What is claimed is:

1. A print head for use in dot matrix printers for printing with a back and forth traverse of the print head along a platen, the print head comprising:

a plurality of stylus actuator assemblies mounted on a head frame and arranged one after the other in upper and lower rows and with all the stylus level with each other; and wherein each assembly having an electromagnetic actuator fixed to the head frame and energized by an impact driving current, a yoke base fixed to the stylus actuator assembly, an armature at one end thereof, having a stylus for printing and at the other end thereof having a plunger attracted by the electromagnetic actuator and being pivotally supported to a yoke base between the stylus and the plunger thereof so as to impact the stylus onto recording paper by attracting the plunger when the impact driving current is supplied to the electromagnetic actuator;

each of all the stylus actuator assemblies having a bent portion at only one side thereof which are substantially bent at right angle to a plane portion thereof and situated on the same side thereof relative to a direction in which the print head traverses; and the bent portions of the stylus actuator assemblies in the upper row being provided on the advancing side thereof to which the print head traverses forwardly, and the bent portions of the stylus actuator assemblies in the lower row are provided on the advancing side thereof to which the print head forwardly traverses.

2. A print head for use in dot matrix printers according to claim 1, wherein the bent portions of the stylus actuator assemblies in the upper row are provided on the rear side thereof to which the print head backwardly traverses, and the bent portions of the stylus actuator assemblies in the lower row are provided on the rear side thereof to which the print head backwardly traverses.

* * * * *